US008099799B2

(12) United States Patent
Hunt

(10) Patent No.: US 8,099,799 B2
(45) Date of Patent: Jan. 24, 2012

(54) SPORTS APPARATUS FOR SECURING THE POSITION OF PROTECTIVE PADS

(76) Inventor: Matthew Hunt, Marietta, GA (US)

( * ) Notice: Subject to any disclaimer, the term of this patent is extended or adjusted under 35 U.S.C. 154(b) by 575 days.

(21) Appl. No.: 12/246,261

(22) Filed: Oct. 6, 2008

(65) Prior Publication Data

US 2010/0083414 A1 Apr. 8, 2010

(51) Int. Cl.
*A41D 27/26* (2006.01)

(52) U.S. Cl. ..... 2/461; 2/16; 2/459; 2/460; 2/44; 2/45

(58) Field of Classification Search ..... 2/16, 300, 2/333, 338, 267, 455, 908, 912, 459, 461, 2/462, 463, 467, 44, 45, 268, 92, 102
See application file for complete search history.

(56) References Cited

U.S. PATENT DOCUMENTS 1,136,307 A * 4/1915 Bourdon ..... 2/456
1,970,130 A 8/1934 Dickenson
2,849,723 A * 9/1958 Marino ..... 2/323
5,692,240 A * 12/1997 Steele ..... 2/129
6,115,948 A * 9/2000 Mitchell ..... 36/136
6,553,579 B1 4/2003 Gillen et al.
6,845,522 B2 1/2005 Beland
6,966,070 B2 11/2005 Gillen et al.
7,353,546 B2 4/2008 Hunt
2007/0011798 A1 * 1/2007 Hunt ..... 2/455

* cited by examiner

*Primary Examiner* — Gary L Welch
*Assistant Examiner* — Andrew W Collins
(74) *Attorney, Agent, or Firm* — Withers & Keys, LLC

(57) ABSTRACT

Securing devices secure the position of protective pads on the arms of a user of the protective pads. A first strap and a second strap are placed over the head with the head of the user passing in between the first and second strap. The first and second straps connect to a third strap at a first connection point. At a second connection point opposite from the first connection point a fourth strap connects to the first and second straps. The third and fourth straps each connect to an attachment device. The attachment devices connect to the protective pads of the wearer. Each one of the straps can each be adjustable to accommodate wearers of varying dimensions. The attachment devices can be detachable from the protective pads so that the wearer can utilize the securing device in conjunction with protective pads that the wearer already has.

20 Claims, 5 Drawing Sheets

SPORTS APPARATUS FOR SECURING THE POSITION OF PROTECTIVE PADS

TECHNICAL FIELD

The present disclosure relates to a protective pad securing device worn by sports participants for securing protective pads in the proper position during play.

BACKGROUND

Protective pads, such as arm and elbow pads, are used widely to protect a sportsman's arm and elbow during contact or highly physical sports. Players engaged in a wide variety of sports use elbow pads of one design or another in field games such as football, hockey, lacrosse, field hockey, and rugby as well as individual or team sports such as the luge, toboggan, skiing and rock climbing.

The most common elbow pads are stand alone pads. A stand alone pad utilizes one or more elastic bands incorporated into the pad design that encase the arm and hold the pad in place through friction. Other types of stand alone pads use hook and loop straps attached to each side of the pad which are used to cinch the pad against the arm. Other types of stand alone pads use an inner layer of neoprene rubber to create a tackier surface to prevent slippage. These devices are lightweight, relatively inexpensive and easily adjusted by the wearer. Over time the pad tends to adapt itself to the wearer or the wearer becomes accustomed to that particular set of pads.

However, each type of these elbow pads present problems. While all of the types of stand alone pads work well prior to competition, all of them will inevitably slide down the player's arm due to perspiration, stretching of the fastening mechanism, physical inertia and player contact. This slippage is a distraction from the game requiring the wearer to constantly adjust the pad during play.

SUMMARY

Embodiments address issues such as these and others by providing a system of straps and attachment mechanisms that include various features conducive to securing protective pads in the proper position. For example, features of some embodiments provide for a set of straps to be worn across the shoulders and back. Particular embodiments allow for existing protective pads to be used. The straps of the apparatus provide a platform from which to suspend any stand alone protective pads allowing the wearer to utilize their current equipment.

A sports apparatus is described that includes a system of straps. A first strap has a first connection point and a second connection point. Adjacent to the first strap is a second strap having a first connection point and a second connection point. A first connection point of a third strap is connected to the first connection point of the first strap and the first connection point of the second strap. A first connection point of a fourth strap is connected to the second connection point of the first strap and the second connection point of the second strap. A first attachment means for connecting to a protective pad is included and is connected to a second connection point of the third strap. A second attachment means for connecting to a protective pad is included and is connected to a second connection point of the second strap.

A sports apparatus is described that includes a system of straps where at least one strap is adjustable. A first strap has a first connection point and a second connection point. Adjacent to the first strap is a second strap having a first connection point and a second connection point. At least the distance between the first connection point and the second connection point of the second strap is adjustable. A first connection point of a third strap is connected to the first connection point of the first strap and the first connection point of the second strap. A first connection point of a fourth strap is connected to the second connection point of the first strap and the second connection point of the second strap. A first attachment means for connecting to a protective pad is included and is connected to a second connection point of the third strap. A second attachment means for connecting to a protective pad is included and is connected to a second connection point of the fourth strap.

A sports apparatus is described that includes a system of straps where at least two of the straps are adjustable. A first strap has a first connection point and a second connection point. The distance between the first connection point and the second connection point of the first strap is adjustable. Adjacent to the first strap is a second strap having a first connection point and a second connection point. The distance between the first connection point and the second connection point of the second strap is adjustable. A first connection point of a third strap is connected to the first connection point of the first strap and the first connection point of the second strap. A first connection point of a fourth strap is connected to the second connection point of the first strap and the second connection point of the second strap. A first attachment means for connecting to a protective pad is included and is connected to a second connection point of the third strap. A second attachment means for connecting to a protective pad is included and is connected to a second connection point of the second strap.

DETAILED DESCRIPTION

Figure 1:
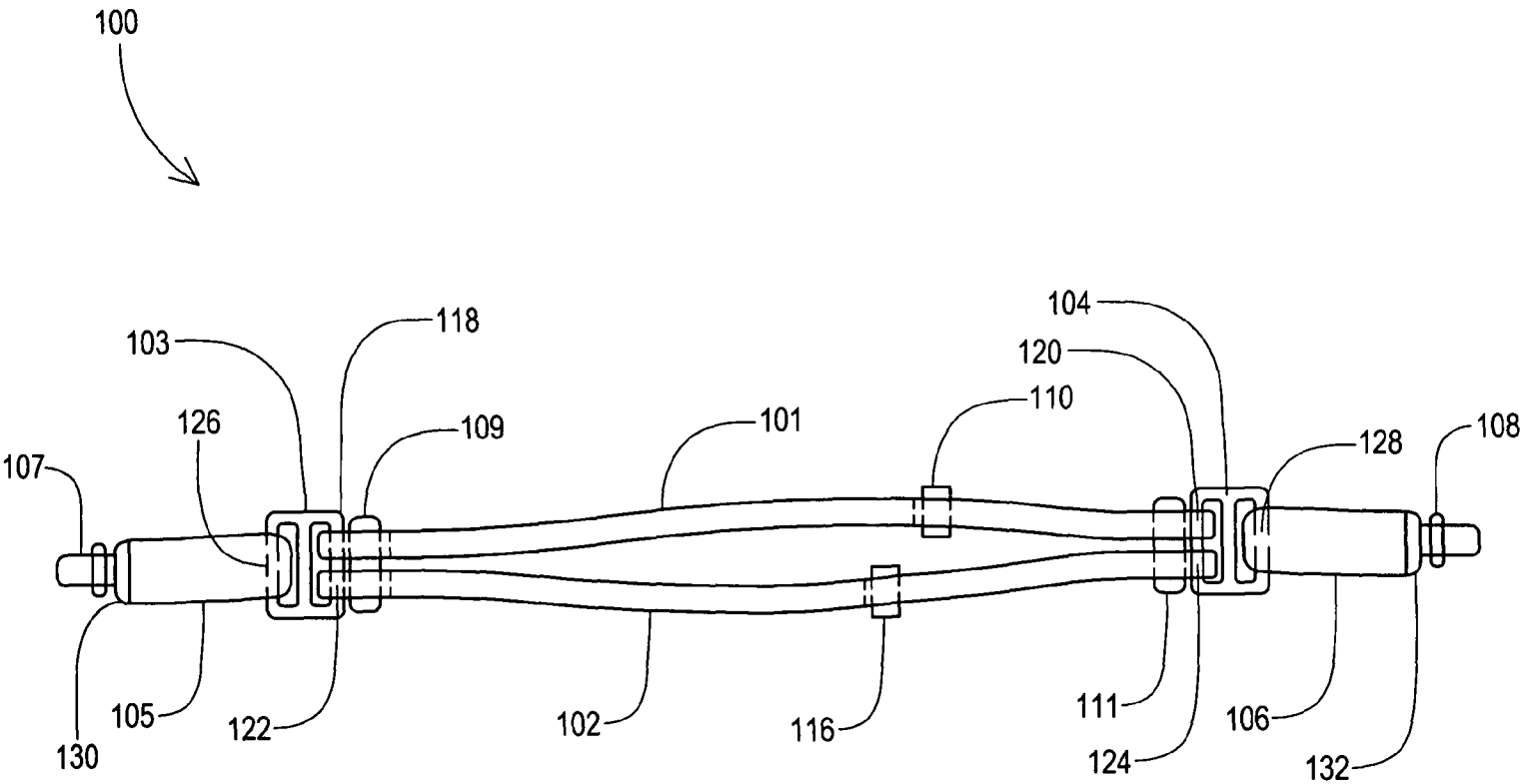
FIG. 1 is a plan view of an embodiment of the present pad securing device.

Embodiments include protective pad securing devices and associated methods for wearing and attaching securing devices to a variety of protective pads. Certain embodiments of securing devices include various features such as the construction of the straps, means to allow for adjusting the length of the straps, the means used to connect the straps, and means to attach the embodiments to protective pads. Certain embodiments of securing devices connect the first and second straps directly to the third and fourth straps while others connect the first and second straps to the third and fourth straps with the use of connectors. Certain embodiments connect the attachment means directly to the third and fourth straps while others secure the attachment means by the use of additional attachment devices. Certain embodiments allow for the distance between the first connection point and the second connection point of a strap to be adjusted.

FIGS. 1-5 show various views of illustrative embodiments of a securing device. The securing device 100 of FIGS. 1 and 2 includes a first strap 101, a second strap 102, a third strap 105 and a fourth strap 106. The width and length of the straps 101, 102, 105 and 106 can be of any width and length to provide for effectively securing pads about the wearer's arms. Particular dimensions of the wearer's body, such as the width of the wearer's shoulders, the diameter of the wearer's neck, the location of the pads about the wearer's arms, and the girth of the wearer's chest will influence the required length for each one of the straps.

One manner of fitting the securing device to the wearer's body can be to construct the straps with excessive length and to provide means to adjust the distance between the connections of the straps that can provide for an effective apparatus. Once the apparatus has been placed on the wearer's body the distance between the connections of the straps can be adjusted to provide for proper functioning of the mechanism. Another manner of fitting the securing device to the wearer's body can be to measure the necessary dimensions of the user's body, the location of the pads to be secured, and then adjust the locations of connections of the straps to provide for proper function of the mechanism. Once the proper adjustments have been made the securing device can be placed on the wearer's body. A further manner of fitting the securing device to the wearer can be to measure the necessary dimensions of the user's body, the location of the pads to be secured, and then to construct the dimensions of the apparatus according to the measurements of the wearer's body. Once the securing device has been constructed with the proper dimensions the securing device can be placed on the wearer's body.

The first strap 101 and the second strap 102 as shown in FIG. 1 are located adjacent to each other. Both the first strap 101 and the second strap 102 feature a first connection point 118 and 122 and a second connection point 120 and 124. The first connection point 118 and 122 of the first strap 101 and the second strap 102 are substantially opposite from the second connection point 120 and 124 of the first strap 101 and the second strap 102. The third strap 105 connects to the first connection point 118 of the first strap 101 and the first connection point 122 of the second strap 102 at a first connection point 126 of the third strap 105. The fourth strap 106 connects to the second connection point 120 of the first strap 101 and the second connection point 124 of the second strap 102 at a first connection point 128 of the fourth strap 106. The third strap 105 and fourth strap 106 both feature a second connection point 130 and 132. The second connection point 130 and 132 of each strap 105 and 106 is substantially opposite of the first connection point 126 and 128 of each strap 105 and 106.

Figure 2:
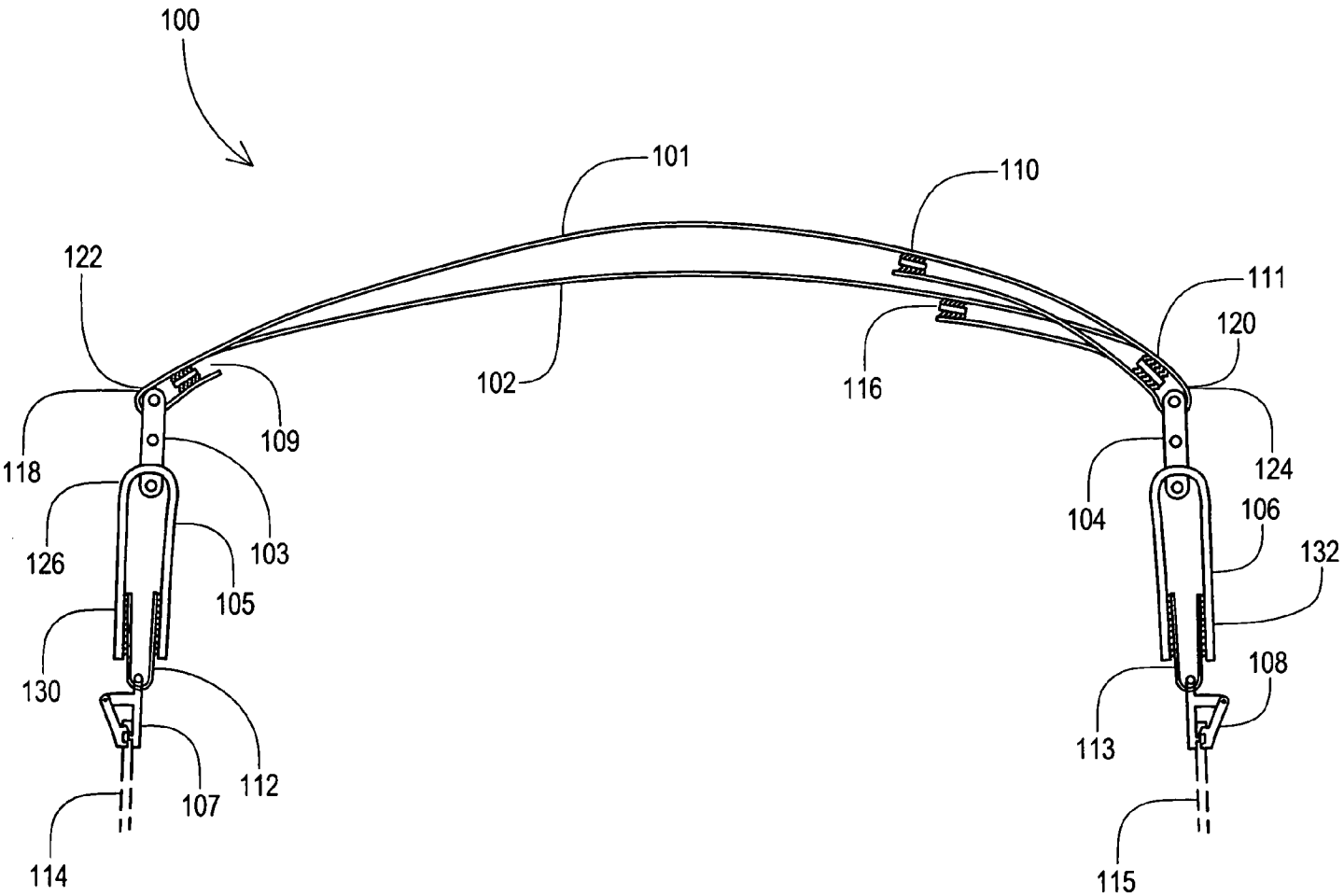
FIG. 2 is a frontal view of an embodiment of the present pad securing device.

The pad securing device as shown in FIG. 2 includes at least two attachment means to secure protective pads placed about a wearer's arms. A first attachment means 107 for allowing manual attachment and detachment of the third strap 105 to a protective pad 114 connects to the second connection point 130 of the third strap 105. A second attachment means 108 for allowing manual attachment and detachment of the fourth strap 106 to a protective pad 115 connects to the second connection point 132 of the fourth strap 106.

One example of an attachment means would be a suspender clip, well known in the art to hold up trousers. Alternative attachment means can also be used such as but not limited to a clasp, clamp, hook, clip, or hook and loop straps (e.g. Velcro® straps) that facilitate the proper function of the apparatus. Using such attachment means allows the wearer to attach his own set of protective pads to the third and fourth straps 105 and 106.

The location of the connection points for each strap is a function of distance where the location of each connection point for a particular strap should be located according to the particular dimensions of the wearer's body and where the location of connection points allows for proper functioning of the apparatus.

In an embodiment, as shown in FIG. 1, the first strap 101 can be worn around the wearer's chest while the second strap 102 can be worn laying below the back of the wearer's neck and across the wearer's shoulders. In the alternative, the second strap 102 can be worn around the wearer's chest and the first strap 101 can be worn across the wearer's shoulders. The first connection point 126 of the third strap 105 can be located near a first shoulder joint of the wearer's and the first connection point 128 of the fourth strap 106 can be located near a second shoulder joint of the wearer's . The third strap 105, as shown in FIG. 2, can extend in a substantially parallel direction to a first arm of the wearer and down to engage the first protective pad 114 placed about a first elbow of the wearer. The fourth strap 106 can extend in a substantially parallel direction to a second arm of the wearer and down to engage the second protective pad 115 placed about a second elbow of the wearer. The protective pads can be placed about other locations of the wearer's arms other than the elbows.

Figure 4:
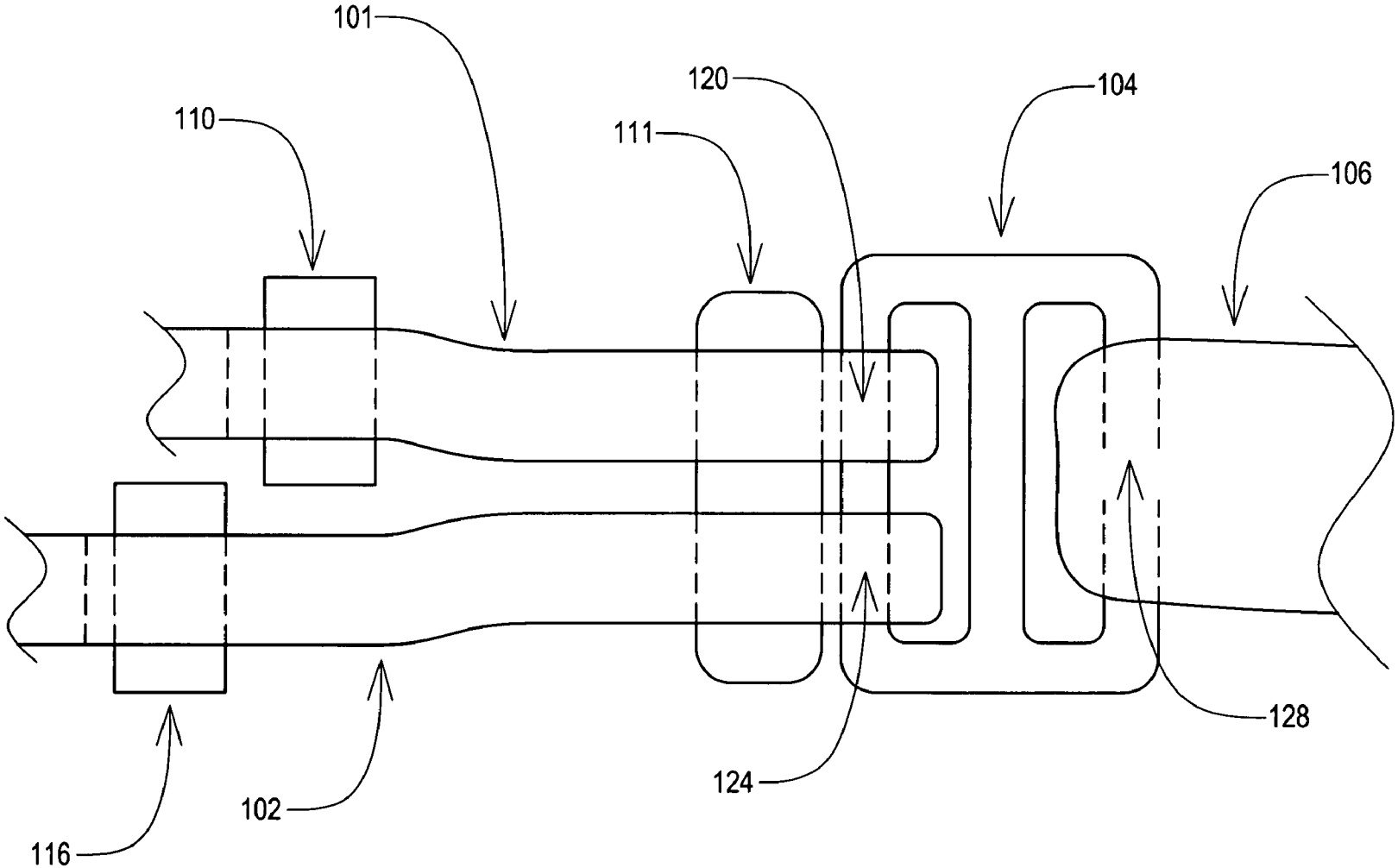
FIG. 4 is a close-up plan view of the second connection point of the first strap, the second connection point of the second strap, a connection means, and the first connection point of the fourth strap.

The manner in which the straps are connected at each connection point can vary. In one embodiment, the connections between the straps can be accomplished by the straps attaching directly to each other. The connection between the straps can be accomplished by various means such as stitching, rivets, adhesive, snaps, staples, buttons or any other equivalent means. The individual straps can also be connected to each other at the connection points with a first connector 103 and a second connector 104 as shown in FIGS. 1 and 2. An embodiment of the second connector 104 is shown in detail in FIG. 4. As shown in FIG. 4, the second connector 104 can connect to the second connection point 120 of the first strap 101, the second connection point 124 of the second strap 102, and the first connection point 128 of the fourth strap 106. As shown in FIG. 1, the first connector 103 can connect to the first connection point 118 of the first strap 101, the first connection point 122 of the second strap 102, and the first connection point 126 of the third strap 105.

The first connector 103 and the second connector 104, in an embodiment as shown in FIG. 1, can each be in the form of bar slide connectors. The connectors 103 and 104 can each also include a first aperture and a second aperture where the first strap 101 and the second strap 102 pass through the first aperture of each connector, the third strap 105 passes through the second aperture of the first connector 103, and the fourth strap 106 passes through the second aperture of the second connector 104. Additional embodiments of the connectors 103 and 104 can be used. Other embodiments of the connectors 103 and 104 can be in the form of simple structures such as each connector comprising a ring. An embodiment of the connectors can also take more complex forms, such as each connector including more than two apertures, such as where there is an aperture dedicated to each strap on each connector.

In an embodiment, as shown in FIGS. 1 and 2, the distance between the first connection point of a strap and the second connection point of a strap can be adjusted. The distance between the first connection point 118 and the second connection point 120 of the first strap 101 can be adjusted. Similarly, the distance between the first connection point 122 and the second connection point 124 of the second strap 102 can be adjusted. The distance between the first connection point 126 and the second connection point 130 of the third strap 105 can be adjusted. Furthermore, the distance between the first connection point 128 and the second connection point 132 of the fourth strap 106 can be adjusted.

In an embodiment as shown in FIGS. 1 and 2, a wafer, such as 109, or 111, can be provided to allow for the location of a connection point, such as 118, 120, 122 or 124, to be adjusted. Each wafer can be attached and detached from points along the strap that the wafer is used upon. Each wafer can have a first side and a second side. Each side of the wafer can be constructed of a material that allows the wafer to attach to a strap by pressing with adequate force against the strap and to be detached from the strap by adequate force pulling the wafer away from the strap. This capability of detaching and reattaching allows for the points that a wafer attaches to a strap to be moved back and forth along the strap. The detach and reattach capability can be accomplished by each side of the wafer being constructed of a fastener, such as a hook type fastener. The surface of each one of the straps can provide for the looped surface for the hooked wafer to detach from a strap and then again attach to the strap (e.g. Velcro® fasteners). This detaching and reattaching of the wafers to the straps can be described as detachably attaching. Alternative means, that may or may not include wafers, can be used to allow for adjusting the locations of the connection points and to provide for the capability of detachably attaching. These alternative means can include but are not limited to clasps, clamps, hooks, clips, buttons, or snaps that are placed about the straps 101, 102 or on one or both sides of the wafers 109, 111 that allow the connection points to vary.

Figure 3:
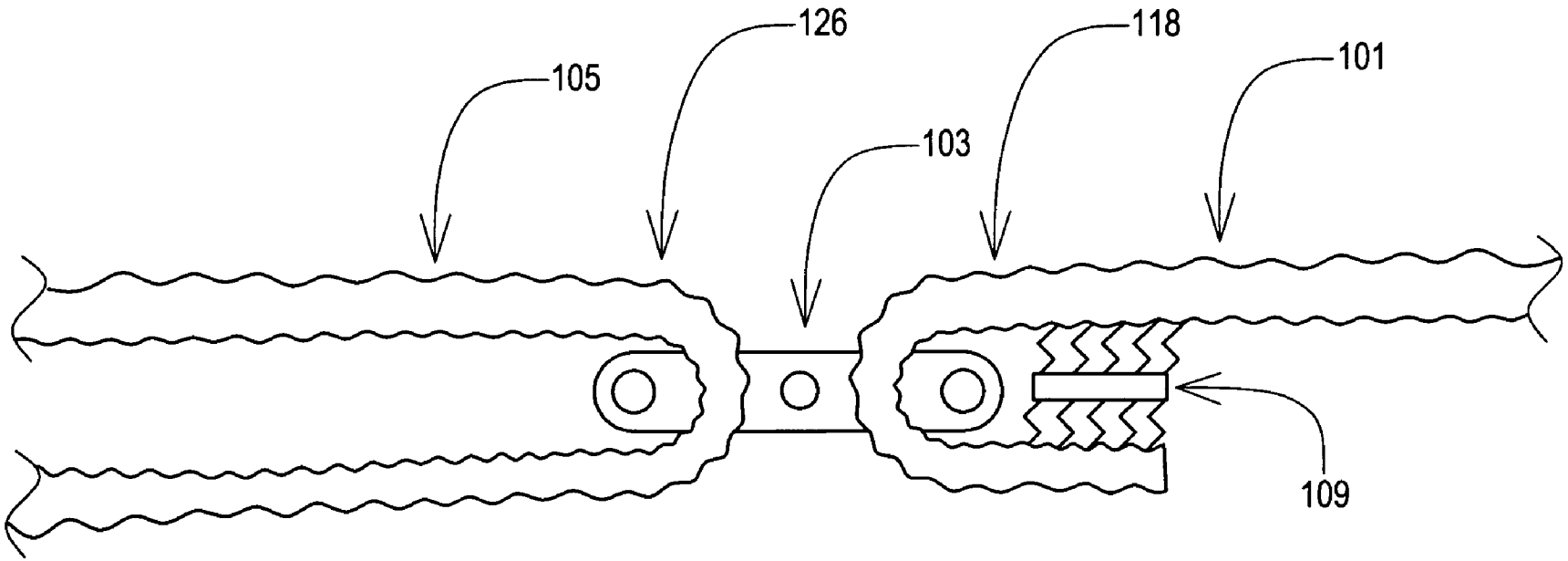
FIG. 3 is a cross-sectional view of the first connection point of the first strap, a connecting means, and the first connection point of the third strap.

In an embodiment, shown in detail in FIG. 3, a first wafer 109 can be used to connect the first strap 101 to the first connector 103 at the first connection point 118 of the first strap 101. The first strap 101 can include a first end section and a mid-section. The first end section can be separated from the mid-section by the first strap 101 passing through the first connector 103 and the first end section extending from the first connector 103 such that the first end section attaches to the first side of the first wafer 109 and the second side of the first wafer 109 attaches to the mid-section of the first strap 101. The point at where the first strap 101 passes through the first connector 103 is the first connection point 118 of the first strap 101.

The first wafer 109 can also be used to connect the second strap 102 to the first connector 103 at the first connection point 122 of the second strap 102, as shown in FIG. 1. The second strap 102 can include a first end section and a mid-section. The first end section can be separated from the mid-section by the second strap 102 passing through the first connector 103 and the first end section extending from the first connector 103 such that the first end section attaches to the first side of the first wafer 109 and the second side of the first wafer 109 attaches to the mid-section of the second strap 102. The point at where the second strap 102 passes through the first connector 103 is the first connection point 122 of the second strap 102. It can be appreciated that a separate wafer can be used to connect the second strap 102 to the first connector 103 at the first connection point 122 of the second strap 102, rather than the first strap 101 and the second strap 102 sharing the first wafer 109 at their first connection point 118 and 122. The first wafer 109 can abut against the first connector 103 such that the first connection point 118 of the first strap 101 and the first connection point 122 of the second strap 102 are locked in place about the first connector 103.

A second wafer 111 can be used to connect the first strap 101 to the second connector 104 at the second connection point 120 of the first strap 101, as shown in FIG. 2. The first strap 101 can include a second end section. The second end section can be separated from the mid-section by the first strap 101 passing through the second connector 104 and the second end section extending from the second connector 104 such that the second end section attaches to the first side of the second wafer 111 and the second side of the second wafer 111 attaches to the mid-section of the first strap 101. The point at where the first strap 101 passes through the second connector 104 is the second connection point 120 of the first strap 101.

The second wafer 111 can also be used to connect the second strap 101 to the second connector 104 at the second connection point 124 of the second strap 102, as shown as FIG. 2. The second strap 102 can include a second end section. The second end section can be separated from the mid-section by the second strap 102 passing through the second connector 104 and the second end section extending from the second connector 104 such that the second end section attaches to the first side of the second wafer 111 and the second side of the second wafer 111 attaches to the mid-section of the second strap 102. The point at where the second strap 102 passes through the second connector 104 is the second connection point 124 of the second strap 102. The second wafer 111 can abut against the second connector 104 such that the second connection point 120 of the first strap 101 and the second connection point 124 of the second strap 102 are locked in place against the second connector 104. It can be appreciated that a separate wafer can be used to connect the second strap 102 to the second connector 104 at the second connection point 122 of the second strap 102, rather than the first strap 101 and the second strap 102 sharing the second wafer 111 at their second connection point 120 and 124.

As shown in FIG. 2, the distance between the first connection point 118 and the second connection point 120 of the first strap 101 can be adjusted by altering where the second wafer 111 attaches to the second end section of the first strap 101. To decrease the distance between the first connection point 118 and the second connection point 120, the point of attachment of the second wafer 111 to the second end section of the first strap 101 can be moved further away from the end of the first strap 101. To increase the distance between the first connection point 118 and the second connection point 120, the point of attachment of the second wafer 111 to the second end section of the first strap 101 can be moved closer to the end of the first strap 101. In a similar fashion, the distance between the first connection point 122 and the second connection point 124 of the second strap 102 can be adjusted by altering where the second wafer 111 attaches to the second end section of the second strap 102 as shown in FIG. 2. It can be appreciated that the distance between the first connection point 118 and the second connection point 120 of the first strap 101 can also be adjusted by altering where the first wafer 109 attaches to the first end section of the first strap 101. Similarly, the distance between the first connection point 122 and the second connection point 124 of the second strap 102 can be adjusted by altering where the first wafer 109 attaches to the end section of the second strap 102.

The distance between the first connection point 118 and the second connection point 120 of the first strap 101 can also be adjusted by altering where the second wafer 111 is attached to the mid-section of the first strap 101, as shown in FIG. 2. The distance between the first connection point 118 and the second connection point 120 can be increased by moving the point of attachment of the second wafer 111 to the mid-section of the first strap 101 closer to the second connector 104. The distance between the first connection point 118 and the second connection point 120 can be decreased by moving the point of attachment of the second wafer 111 to the mid-section of the first strap 101 further away from the second connector 104. Likewise, as illustrated in FIG. 2, the distance between the first connection point 122 and the second connection point 124 of the second strap 102 can be adjusted by altering where the second wafer 111 is attached to the mid-section of the second strap 102. It can be appreciated that the distance between the first connection point 118 and the second connection point 120 of the first strap 101 can also be adjusted by altering where the first wafer 109 is attached to the mid-section of the first strap 101. Similarly, the distance between the first connection point 122 and the second connection point 124 of the second strap 102 can be adjusted by altering where the first wafer 109 is attached to the mid-section of the second strap 102.

As illustrated in FIG. 2, a third wafer 110 can be used to attach the loose end of the second end section of the first strap 101 to the mid-section of the first strap 101. A fourth wafer 116 can be used to attach the loose end of the second end section of the second strap 102 to the mid-section of the second strap 102. It can be appreciated that additional wafers can be used to connect the loose end of the first end section of the first strap 101 to the mid-section of the first strap 101 and to attach the loose end of the first end section of the second strap 102 to the mid-section of the second strap 102.

The distance between the two connection points 118 and 120 of the first strap 101 can be adjusted independently of the distance between the two connection points 122 and 124 of the second strap 102. Furthermore, the distance between the first connection point of a strap can be adjusted independently of the second connection point of a strap. As stated above, other attachment devices such as but not limited to detachable buckles, clips, clamps, snaps, buttons and hooks can be used in place of the wafers 109 and 111 to connect the first strap 101 and the second strap 102 to the first connector 103 and the second connector 104 and still provide adjustability for each connection point and to provide for detachably attaching the straps.

Additional mechanisms can be used to connect the third strap 105 and the fourth strap 106 to the attachment means 107 and 108. As shown in FIG. 2, the use of hook and loop fasteners can be used to allow for the distance between the first connection point 126 and the second connection point 130 of the third strap 105 to be adjusted. In a similar fashion, as shown by FIG. 2, the use of hook and loop fasteners can be used to allow for the distance between the first connection point 128 and the second connection point 132 of the fourth strap 106 to be adjusted. Other means can be used to allow the distance between the first connections points 126 and 128 to be varied from the second connection points 130 and 132. Examples of these means include but are not limited to straps configured with buttons, snaps, hooks, buckles, clips or clamps.

Figure 5:
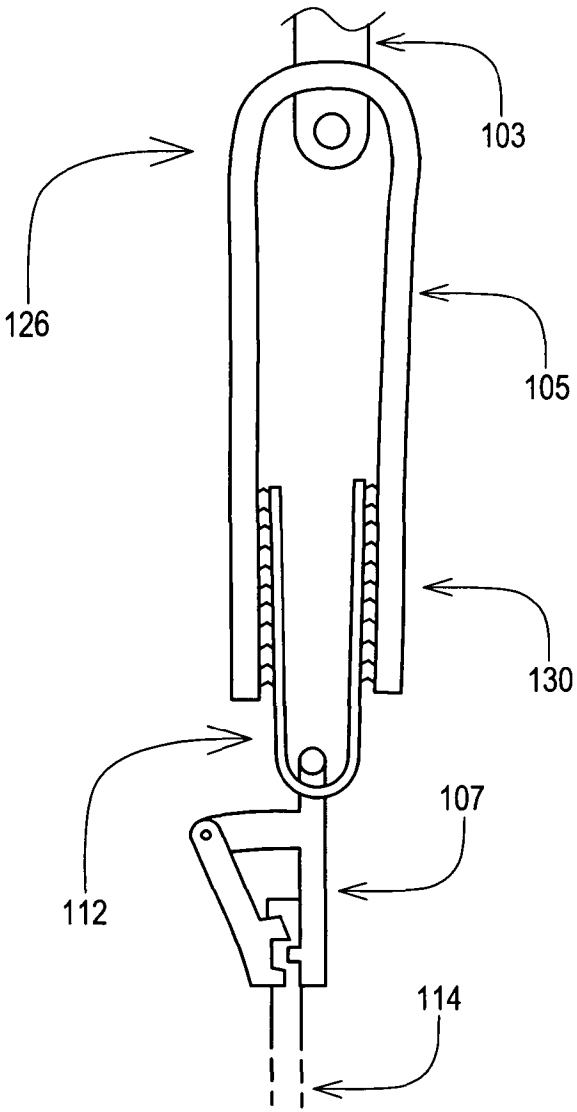
FIG. 5 is a cross-sectional view of the third strap connecting to the first attachment means for connecting to a protective pad with a means for detachably connecting the attachment means to the third strap.

FIG. 5 illustrates an embodiment that allows for the distance between the first connection point 126 and the second connection point 130 of the third strap 105 to be adjusted. The third strap 105 can further include a first end section and a second end section. The first end section of the third strap 105 can be separated from the second end section by the first end section passing through the first connector 103 and extending from the first connector 103 such that the first end section is adjacent to the second end section. Where the third strap passes through the first connector 103 is the location of the first connection point of the third strap 126. A fifth strap 112 can include a first end section and a second end section. The first end section can be separated from the second end section by the first end section passing through the first attachment means 107 and extending from the first attachment means 107 such that the first end section is adjacent to the second end section. The first end section of the fifth strap 112 can attach to the first end section of the third strap 105 and the second end section of the fifth strap 112 can attach to the second end section of the third strap 105. The point of attachment between the third strap 105 and the fifth strap 112 forms the second connection 130 of the third strap 105.

The distance between the first connection point 126 and the second connection point 130 of the third strap 105 can be adjusted by varying where the fifth strap 112 and the third strap 105 attach to each other. If the end sections of the fifth strap 112 are attached to the end sections of the third strap 105 such that there is an increased amount of overlap between the end sections of the two straps then the distance between the two connection points 126 and 130 is shortened. Likewise, if the straps 105 and 112 are attached to each other with a lessened amount of overlap then the distance between the connection points 126 and 130 is increased.

An embodiment, as shown in FIG. 2, also allows for the distance between the first connection point 128 and the second connection point 132 of the fourth strap 106 to be adjusted. The fourth strap 106 can include a first end section and a second end section. The first end section can be separated from the second end section by the first end section passing through the second connector 104 and extending from the second connector 104 such that the first end section is adjacent to the second end section. Where the fourth strap 106 passes through the second connector 104 is the location of the first connection point 128 of the fourth strap 106. A sixth strap 113 can include a first end section and a second end section. The first end section can be separated from the second end section by the first end section passing through the second attachment means 108 and extending from the second attachment means 108 such that the first end section is adjacent to the second end section. The first end section of the sixth strap 113 can attach to the first end section of the fourth strap 106 and the second end section of the sixth strap 113 can attach to a second end section of the fourth strap 106. The point of attachment between the fourth strap 106 and the sixth strap 113 forms the second connection point 132 of the fourth strap 106.

The distance between the first connection point 128 and the second connection point 132 of the fourth strap 106 can be adjusted by varying where the sixth strap 113 and the fourth strap 106 attach to each other. If the end sections of the sixth strap 113 are attached to the end sections of the fourth strap 106 such that there is an increased amount of overlap between the end sections of the two straps then the distance between the two connection points 128 and 132 is shortened. Likewise, if the straps 106 and 113 are attached to each other with a lessened amount of overlap then the distance between the connection points 128 and 132 is increased.

In the embodiment as shown in FIG. 2, the fifth strap 112 and sixth strap 113 can be constructed of a hooked fastener material while the third strap 105 and fourth strap 107 can be constructed of a looped fastener material such that at each point where the fifth strap 112 attaches to the third strap 107 and the sixth 113 strap attaches to the fourth strap 108 a hook and loop fastening is formed (e.g. Velcro® straps). The use of the hook and loop fastening allows the straps to be attached, detached, and attached again repeatedly. This detaching and reattaching of the straps to each other can be described as detachably attaching. It can be appreciated that one example of a hook and loop fastening the fifth strap 112 and the sixth strap 113 can be constructed of a looped fastener, and the third strap 105 and the fourth strap 107 constructed of a hooked fastener. Other means of detaching and reattaching of the straps may be used, such as but not limited to clasps, clamps, hooks, clips, buttons, or snaps.

It will be appreciated that each one of the straps of FIGS. 1 and 2 can be composed of any desired material that facilitates the proper functioning of the apparatus. In an embodiment, the straps 101, 102, 105 and 106 can be composed of an elastic material. Certain materials such as lycra, neoprene, and spandex can be employed in the construction of the straps. In an embodiment, the straps 101, 102, 105 and 106 can be composed of a non-elastic material such as nylon or polypropylene. In another embodiment, in place of flat straps, for one or more of the straps 101, 102, 105 and 106, straps of varying cross sections, such as straps with a circular or an elliptical cross section can be used. Certain examples of straps not having a flat cross section can include cord, rope or custom formed webbing. The straps 101, 102, 105 and 106 can also be composed of a perforated material or material including slots or other types of venting to allow better airflow through the apparatus. Furthermore, the width of the straps 101, 102, 105 and 106 relatively to each other can vary. The first strap 101 can be of a greater or lesser width than the second strap 102. The third strap 105 and fourth strap 106 can be of a greater or lesser width than either the first strap 101 or second strap 102 depending upon a particular application. Additionally, the third strap 105 can be of a greater or lesser width than that of the fourth strap 106.

While various embodiments of a sports apparatus have been shown and described, it will be understood by those skilled in the art that various other changes in the form and details can be made therein without departing from the spirit and scope of the disclosed invention embodiments.

What is claimed is:

1. A sports apparatus that secures a position of protective pads worn on each arm of a user, comprising:

a first strap having a first connection point and a second connection point;

a second strap having a first connection point and a second connection point, the first connection point of the first strap adjacent to the first connection point of second strap, and the second connection point of the first strap adjacent to the second connection point of the second strap;

first connector means having at least one aperture for receiving the first connection point of the first strap and the first connection point of the second strap;

second connector means having at least one aperture for receiving the second connection point of the first strap and the second connection point of the second strap;

a third strap having a first connection point and a second connection point, the first connection point connected to the first connector means;

a fourth strap having a first connection point and a second connection point, the first connection point connected to the second connector means;

a first attachment means for allowing manual attachment and detachment of the third strap to a protective pad and being connected to the second connection point of the third strap; and a second attachment means for allowing manual attachment and detachment of the fourth strap to a protective pad and being connected to the second connection point of the fourth strap.

2. The sports apparatus of claim 1, wherein at least the first strap and the second strap are constructed from an elastic material.

3. The sport apparatus of claim 1, wherein the third and fourth straps are adjustable in length.

4. The sports apparatus of claim 1, wherein the first and second straps are of such a length to permit a wearer to place his head in between the first and second straps.

5. The sports apparatus of claim 1, wherein the third and fourth straps are of such a length to permit a wearer to attach protective pads to the first attachment means and the second attachment means where the protective pads have been placed about each one of a wearer's arms.

6. The sports apparatus of claim 1 wherein the first connector means and the second connector means are a same type.

7. The sports apparatus of claim 6 further comprising:

a first wafer having a first side and a second side, the second side located substantially opposite the first side;

the first strap further having a mid-section and a first end section, the first end section separated from the mid-section by the first strap passing through the first connector and the first end section extending from the first connector means such that the first end section detachably attaches to the first side of the first wafer and the mid-section detachably attaches to the second side of the first wafer, the location at which the first strap passes through the first connector means being the first connection point of the first strap; and the second strap further having a mid-section and a first end section, the first end section separated from the mid-section by the second strap passing through the first connector means and the first end section extending from the first connector means such that the first end section detachably attaches to the first side of the first wafer and the mid-section detachably attaches to the second side of the first wafer, the location at which the second strap passes through the first connector means being the first connection point of the second strap.

8. The sports apparatus of claim 6 further comprising:

a second wafer having a first side and a second side, the second side located substantially opposite from the first side;

the first strap further having a second end section, the second end section separated from the mid-section by the first strap passing through the second connector means and the second end section extending from the second connector means such that the second end section detachably attaches to the first side of the second wafer and the mid-section detachably attaches to the second side of the second wafer, the location at which the first strap passes through the second connector means being the second connection point of the first strap; and the second strap further having a second end section, the second end section separated from the mid-section by the second strap passing through the second connector means and the second end section extending from the second connector means such that the second end section detachably attaches to the first side of the second wafer and the mid-section detachably attaches to the second side of the second wafer, the location at which the second strap passes through the second connector means being the second connection point of the second strap.

9. The sports apparatus of claim 6 further comprising:

a fifth strap having a first end section and a second end section, the first end section separated from the second end section by the first end section passing through the first attachment means and extending from the first attachment means such that the first end section is adjacent to the second end section;

a sixth strap having a first end section and a second end section, the first end section separated from the second end section by the first end section passing through the second attachment means and extending from the second attachment means such that the first end section is adjacent to the second end section;

the third strap further having a first end section and a second end section, the first end section separated from the second end section by the first end section passing through the first connector means and extending from the first connector such that the first end section is adjacent to the second end section, the first end section of the third strap detachably attaching to the first end section of the fifth strap, the second end section of the third strap detachably attaching to the second end section of the fifth strap, the location at which the third strap passes through the first connector means being the first connection point of the third strap, and the location at which the first end section and the second end section of the third strap detachably attaches to the first end section and the second end section of the fifth strap being the second connection point of the third strap; and the fourth strap further having a first end section and a second end section, the first end section separated from the second end section by the first end section passing through the second connector means and extending from the second connector means such that the first end section is adjacent to the second end section, the first end section of the fourth strap detachably attaching to the first end section of the sixth strap and the second end section of the fourth strap detachably attaching to the second end section of the sixth strap, the location at which the fourth strap passes through the second connector means being the first connection point of the fourth strap, and the location at which the first end section and the second end section of the fourth strap detachably attaches to the first end section and the second end section of the sixth strap being the second connection point of the fourth strap.

10. The sports apparatus of claim 1, wherein:

the first connector means further having a first aperture being the location where the first strap and the second strap pass through the first connector means;

the first connector means further having a second aperture being the location where the third strap passes through the first connector means;

the second connector means further having a first aperture being the location where the first strap and the second strap pass through the second connector means; and the second connector means further having a second aperture being the location where the fourth strap passes through the second connector means.

11. A sports apparatus that secures a position of protective pads worn on each arm of a user, comprising:

a first strap having a first connection point and a second connection point;

a second strap having a first connection point and a second connection point, the first connection point of the first strap adjacent to the first connection point of second strap, the second connection point of the first strap adjacent to the second connection point of the second strap;

first connector means having a first aperture for receiving the first connection point of the first strap and the first connection point of the second strap;

second connector means being a same type as the first connector means and having a first aperture for receiving the second connection point of the first strap and the second connection point of the second strap;

a third strap having a first connection point and a second connection point, the first connection point connected to the first connector means;

a fourth strap having a first connection point and a second connection point, the first connection point connected to the second connector means;

a first attachment means for allowing manual attachment and detachment of the third strap to a protective pad and being connected to the second connection point of the third strap; and a second attachment means for allowing manual attachment and detachment of the fourth strap to a protective pad and being connected to the second connection point of the fourth strap.

12. The sports apparatus of claim 11, wherein the width of the third and fourth straps is greater than the width of the first and second straps.

13. The sports apparatus of claim 11, wherein the distance between the first connection point of the first strap and the second connection point of the first strap is adjustable.

14. The sports apparatus of claim 11 wherein:

the distance between the first connection point of the third strap and the second connection point of the third strap is adjustable; and the distance between the first connection point of the fourth strap and the second connection point of the fourth strap is adjustable.

15. The sports apparatus of claim 13 wherein the distance between the first connection point of the second strap and the second connection point of the second strap is adjustable.

16. A sports apparatus that secures a position of protective pads worn on each arm of a user, comprising:

a first strap having a first connection point and a second connection point;

a second strap having a first connection point and a second connection point, the first connection point of the first strap adjacent to the first connection point of the second strap, and the second connection point of the first strap adjacent to the second connection point of the second strap;

first connector means having a first aperture for receiving the first connection point of the first strap and the first connection point of the second strap, the first aperture holding the first strap adjacent to the second strap with a separation between the first strap and the second strap within the first aperture being less than or equal to the width of the first strap;

second connector means having a first aperture for receiving the second connection point of the first strap and the second connection point of the second strap, the first aperture of the second connector means holding the first strap adjacent to the second strap with a separation between the first strap and the second strap within the first aperture of the second connector means being less than or equal to the width of the first strap;

a third strap having a first connection point and a second connection point, the first connection point of the third strap connected to the first connection point of the first strap and the first connection point of the second strap;

a fourth strap having a first connection point and a second connection point, the first connection point of the fourth strap connected to the second connection point of the first strap and the second connection point of the second strap;

a first attachment means for allowing manual attachment and detachment of the third strap to a protective pad, the first attachment means connected to the second connection point of the third strap; and a second attachment means for allowing manual attachment and detachment of the fourth strap to a protective pad, the second attachment means connected to the second connection point of the fourth strap.

17. The sports apparatus of claim 16 wherein:

the distance between the first connection point of the third strap and the second connection point of the third strap is adjustable; and the distance between the first connection point of the fourth strap and the second connection point of the fourth strap is adjustable.

18. The sports apparatus of claim 16, wherein the first attachment means allows for detachably attaching the first attachment means to the third strap and where the second attachment means allows for detachably attaching the second attachment means to the fourth strap.

19. The sports apparatus of claim 16, wherein:

the location on the first strap at which the first connection point is located can be adjusted independently from the location on the first strap at which the second connection point is located; and the location on the second strap at which the first connection point is located can be adjusted independently from the location on the second strap at which the second connection point is located.

20. The sports apparatus of claim 16, wherein:

the distance between the first connection point of the first strap and the second connection point of the first strap is adjustable independently from adjusting the distance between the first connection point of the second strap and the second connection point of the second strap.

* * * * *